US006926752B2

(12) United States Patent
Taskinen et al.

(10) Patent No.: US 6,926,752 B2
(45) Date of Patent: Aug. 9, 2005

(54) METHOD FOR THE STABILIZATION OF A FLUIDIZED BED IN A ROASTING FURNACE

(75) Inventors: Pekka Taskinen, Pori (FI); Maija-Leena Metsärinta, Vanha-Ulvila (FI); Jens Nyberg, Kokkola (FI); Aija Rytioja, Kokkola (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/416,863

(22) PCT Filed: Nov. 13, 2001

(86) PCT No.: PCT/FI01/00982

§ 371 (c)(1),
(2), (4) Date: Oct. 21, 2003

(87) PCT Pub. No.: WO02/40723

PCT Pub. Date: May 23, 2002

(65) Prior Publication Data

US 2004/0050209 A1 Mar. 18, 2004

(30) Foreign Application Priority Data

Nov. 15, 2000 (FI) ..... 20002495

(51) Int. Cl.[7] ..... C22B 1/10

(52) U.S. Cl. ..... 75/387; 423/99; 423/148; 432/17

(58) Field of Search ..... 75/387, 754; 423/99, 423/110, 148, 17

(56) References Cited

U.S. PATENT DOCUMENTS

| | | | | |
|---|---|---|---|---|
| 2,596,580 A | | 5/1952 | McKay et al. | 75/9 |
| 2,855,287 A | | 10/1958 | Cyr | 75/9 |
| 3,957,484 A | | 5/1976 | Fekete et al. | 75/9 |
| 4,619,814 A | | 10/1986 | Salter et al. | 423/27 |
| 5,762,891 A | | 6/1998 | Downey et al. | 423/87 |
| 6,814,571 B2 | * | 11/2004 | Nyberg et al. | 432/77 |

FOREIGN PATENT DOCUMENTS

JP 2000074799 * 3/2000

OTHER PUBLICATIONS

Abstract, Derwent–ACC–NO: 1990–191178 Derwent–Week: 199025 Patent No. SU 1502643A Aug. 23, 1989.*

Abstract, Accession No. 1989–226106, Patent No. SU 1437358, Nov. 15, 1988.

* cited by examiner

*Primary Examiner*—Melvyn Andrews
(74) *Attorney, Agent, or Firm*—Morgan & Finnegan, L.L.P.

(57) ABSTRACT

This invention relates to a method for stabilizing a fluidized bed used in roasting by adjusting the oxygen content of the roasting gas in the bed. The fine-grained material for roasting is fed into the furnace above the fluidized bed and the roasting gas, which causes the fluidizing, is fed into the bottom of the furnace through a grate. In this method, the total amount of oxygen in the roasting gas to be fed and the average total oxygen requirement of the material to be roasted are calculated and the ratio between them regulated so that the oxygen coefficient in the bed is over 1.

11 Claims, No Drawings

METHOD FOR THE STABILIZATION OF A FLUIDIZED BED IN A ROASTING FURNACE

This invention relates to a method for stabilizing a fluidized bed used in roasting by adjusting the oxygen content of the roasting gas in the bed. The fine-grained material for roasting is fed into the furnace above the fluidized bed and the roasting gas, which causes the fluidized bed, is fed into the bottom of the furnace through a grate. In this method, the total amount of oxygen in the roasting gas to be fed and the average total oxygen requirement of the material to be roasted are calculated and the ratio between them regulated so that the oxygen coefficient in the bed is over 1.

Roasting can be done in several different furnaces. Nowadays however, the roasting of fine-grained material usually takes place with the fluidized bed method. The material to be roasted is fed into the roasting furnace via the feed units in the wall of the furnace above the fluidized bed. On the bottom of the furnace there is a grate, via which oxygen-containing gas is fed in order to fluidize the concentrate. The oxygen-containing gas usually used is air. There are usually in the order of 100 gas nozzles/$m^2$ under the grate. As the concentrate becomes fluidized, the height of the feed bed rises to about half that of the fixed material bed. The pressure drop in the furnace is formed by the resistance of the grate and that of the bed. The resistance of the bed is more or less the mass of the bed when the bed is in a fluidized state. The pressure drop is in the range of 240–280 mbar.

The roasting of sulfides is described for example in the book by Rosenqvist, T.: Principles of Extractive Metallurgy, pp. 245–255, McGraw-Hill, 1974, USA. According to Rosenqvist, roasting is the oxidizing of metal sulfides, giving rise to metal oxides and sulfur dioxide. For example, zinc sulfide and pyrite oxidize as follows:

$$2ZnS+3O_2 \rightarrow 2ZnO+2SO_2 \quad (1)$$

$$2FeS_2+5\tfrac{1}{2}O_2 \rightarrow Fe_2O_3+4SO_2 \quad (2)$$

In addition, other reactions may occur such as the formation of $SO_3$, the sulfating of metals and the formation of complex oxides such as zinc ferrite ($ZnFe_2O_4$). Typical materials for roasting are copper, zinc and lead sulfides. Roasting commonly takes place at temperatures below the melting point of sulfides and oxides, generally below 900–1000° C. On the other hand, in order for the reactions to occur at a reasonable rate, the temperature must be at least of the order of 500–600° C. The book presents balance drawings, which show the conditions demanded for the formation of various roasting products. For instance, when air is used as the roasting gas, the partial pressure of $SO_2$ and $O_2$ is about 0.2 atm. Roasting reactions are strongly exothermic, and therefore the bed needs a cooling arrangement.

The calcine is removed from the furnace partially via an overflow aperture, and is partially transported with the gases to the waste heat boiler and from there on to the cyclone and electrostatic precipitators, from where the calcine is recovered. Usually the overflow aperture is located on the opposite side of the furnace from the feed units. The removed calcine is cooled and ground finely for leaching.

For good roasting it is important to control the bed i.e. the bed has to be of stable construction and have other good fluidizing properties and the fluidizing has to be under control. Combustion should be as complete as possible, i.e. the sulfides must be oxidized completely into oxides. The calcine has also to come out of the furnace well, i.e. the particle size of the calcine must be within certain limits. The particle size of the calcine is known to be affected by the chemical composition and mineralogy of the concentrate as well as by the temperature of the roasting gas.

Zinc sulfide concentrates handled in zinc roasters have become more impure over the course of time. Concentrates are no longer anywhere near pure zinc blende, sphalerite, but may contain a considerable amount of iron. Iron is either dissolved in the sphalerite lattice or in the form of pyrite or pyrrhotite. In addition, concentrates often contain sulfidic lead and/or copper. The chemical composition and mineralogy of the concentrates vary enormously. In this way the amount of oxygen required for oxidation of the concentrates also varies, as does the amount of heat produced on combustion. In the technique currently in use the roaster concentrate feed is regulated according to the temperature of the bed using fuzzy logic for example. Thus there is a danger that the oxygen pressure in the fluidized bed drops too low i.e. that the amount of oxygen is insufficient to roast the concentrate. As a result, the bed does not agglomerate normally but remains too fine and at the same time the back pressure of the bed may fall too low, because a fine bed stops fluidizing and channeling occurs. The real oxygen demand of a fluidized bed is unknown, because generally the concentrate mix is not calculated continuously in advance on the basis of its precise composition, nor are there any devices in the bed for measuring the oxygen content. Therefore the operation of a fluidized bed furnace is difficult to regulate and keep stable.

The particle size of the zinc sulfide concentrates to be treated also varies. As a result, it is difficult to know which part of the concentrate will burn in the bed when and which part above the bed transported by the exhaust gas. If a significant amount of the combustion occurs above the bed, less energy is created in the bed than usual and, depending on the regulation method, this may increase the feed.

As stated above, it is known from balance calculations and balance diagrams in the literature that copper and iron together and separately form oxysulfides, which are molten at roasting temperatures and even lower temperatures too. Similarly, zinc and lead as well as iron and lead both form sulfides molten at low temperatures. This kind of sulfide appearance is possible and the likelihood grows if the amount of oxygen in the bed is smaller than that normally required to oxidize the concentrate.

During fluidized bed roasting agglomeration of the product normally occurs, i.e. the calcine is clearly coarser than the concentrate feed. The above-mentioned formation of molten sulfides nevertheless increases agglomeration to a disturbing degree, in that the agglomerates with their sulfide nuclei remain moving around the grate. Agglomerates cause build-ups on the grate and, over the course of time, block the gas nozzles under the grate. It has been noticed in zinc roasters that build-ups containing impure components are formed in the furnace particularly in the part of the grate under the concentrate feed units.

In the article by Nyberg, J. et al: Recent Process Improvements in the Kokkola Zinc Roaster, Lead-Zinc Symposium 2000, Pittsburgh, USA, Oct. 22–25, 2000, pages 399–415, it is stated that the roaster fluidized bed generally moves towards an unstable state when the percentage of the finest fraction in the bed increases. In this case the temperatures of the control thermo-elements diverge, as a result of the fact that the bed is too fine for fluidization and that channeling occurs. In addition, the back pressure of the bed drops and the feed drops.

The literature contains research on a zinc sulfide oxidation model, which works at extremely low oxygen contents.

According to this model, zinc oxide is formed at low oxygen pressures through gas reactions and not through a solid-gas reaction as normal. This means that condensed zinc oxide is extremely fine. However, the power of the fans below the grate is not always sufficient to increase gas feed and likewise the amount of oxygen. On the other hand, the acid plant after the roaster may also cause capacity limitations. The concentrate may also be so fine, that if the gas feed is increased, the material will no longer stay in the fluidized bed but instead will fly out in the flow of gas. Sometimes the quality of the concentrate does not allow changes in the temperature of the bed and with it the reduction in feed and by this means the increase in the amount of oxygen to a sufficient level. There may also be situations where neither of the above regulating methods is possible.

Different ways of regulating roasting conditions have been attempted. U.S. Pat. No. 5,803,949 relates to a method of stabilizing the fluidized bed in the roasting of metal sulfides, where stabilizing occurs by controlling the particle size of the feed. In U.S. Pat. No. 3,957,484 stabilization occurs by feeding the concentrate as a slurry. In the article MacLagan, C. et al: Oxygen Enrichment of Fluo-Solids Roasting at Zincor, Lead-Zinc Symposium 2000, Pittsburgh, USA, Oct. 22–25, 2000, pages 417–426, it is stated that the oxygen content of the roaster exhaust gas is controlled by measurements taken from the gas line after the boiler or the cyclone. These measurements do not, however, tell of the status of the fluidized bed, because the gas line measurements already include leakage air.

In order to correct the deficiencies presented above, a method according to the present invention has now been developed to stabilize a fluidized bed for use in roasting fine material by regulating the oxygen content of the gas in the bed. In order that for instance zinc sulfide concentrate be oxidized into zinc oxide, the oxygen coefficient of the fluidized bed should in theory be at least one. The oxygen coefficient is obtained when the total oxygen feed of the roasting gas is calculated and compared to the total oxygen requirement of the concentrate feed mixture. According to the method now developed, the oxygen coefficient is adjusted to be over 1, preferably at least 1.03. In order to effect a more accurate adjustment, the oxygen content is also measured in the bed itself. The stabilization of the fluidized bed by regulating the oxygen coefficient prevents capacity losses, which result from the build-up formed on the grate and the production stoppages they cause. The essential features of the invention will be made apparent in the attached claims.

According to the present method, it is possible to do the adjustment of the oxygen coefficient on the basis of two process data: first calculate the average oxygen requirement of the feed mixture ($NM^3O_2$/t concentrate mixture) using the calculated oxygen requirements of the studied chemical and mineralogical composition of the each concentrate. The oxygen requirement of the concentrate mixture is entered into the process control equipment whenever the mixture is changed. The second process data required is the total oxygen requirement, which is calculated on the basis of the oxygen requirement of the feed mixture and the concentrate feed (t/h) to be measured continuously. During roasting, the process control equipment measures the oxygen coefficient of the process i.e. it compares the total oxygen feed to the calculated total oxygen requirement. The total oxygen feed is obtained by measuring the amount of gas to be fed via the grate and its oxygen content. The control equipment is given appropriate limit value, and if the oxygen coefficient falls below this limit, the equipment reacts in the prescribed manner e.g. with an alarm or a certain adjustment procedure. These kinds of adjustment procedures are, depending on the situation, the adjustment of the oxygen coefficient to the right range, either by changing the temperature, the amount of grate air or oxygen enrichment either separately or together in different combinations. Pure oxygen may be fed with the grate gas as oxygen enrichment.

As stated previously, with embodiments of the prior art of roasting it has not been able to determine which part of the concentrate will be oxidized in the bed and which part only above the bed and what the percentage of leakage air will be. Thus there is no precise picture of the sufficiency of the amount of oxygen in the bed. Therefore, in order to specify the adjustment action, it is necessary to carry out oxygen content measurement in the bed also. In the present invention the fine-adjustment of oxygen content can be done either continuously or for example only when changing the feed mixture. Probes for instance are used as the measurement device. On the basis of this measurement, the actions described above are carried out as required in order to adjust the oxygen coefficient to the right range. In particular when using oxygen enrichment the avoidance of wasted costs should be kept in mind or feeding oxygen in excess, since pure oxygen is expensive.

The invention is described further in the following example:

EXAMPLE 1

A concentrate with a sphalerite composition was compared to a zinc concentrate containing pyrite. Calculating the oxygen requirement of the concentrates showed that the oxygen requirement of the sphalerite concentrate in roasting is 338 $Nm^3$/t and for the pyrite-containing concentrate 378 $Nm^3$/t, in other words the oxygen requirement of the pyrite-containing concentrate is over 10% greater than that of the sphalerite concentrate. The mineral contents of the concentrates are shown in Table 1.

TABLE 1

| Mineral | Sphalerite concentrate w-% | Pyrite-containing concentrate w-% |
|---|---|---|
| $CuFeS_2$ | 0.09 | 1.73 |
| FeS | 2.54 | 2.85 |
| $FeS_2$ | 0.35 | 21.63 |
| ZnS | 91.66 | 68.11 |
| PbS | 1 | 3.11 |
| CdS | 0.24 | 0.18 |
| $SiO_2$ | 0.94 | 0.43 |
| $CaSO_4$ | 0.83 | 0.1 |
| $CaCO_3$ | 1.05 | 0.5 |
| others | 1.3 | 1.36 |

What is claimed is:

1. A method of stabilizing a fluidized bed used in roasting of a fine-grained material, comprising:

calculating the total amount of oxygen in the roasting gas to be fed;

calculating the average total oxygen requirement of the material to be roasted;

measuring the oxygen content within the fluidized bed; and regulating a ratio between the total amount of oxygen in the roasting gas to be fed and the average total oxygen requirement of the material to be roasted so that the oxygen coefficient in the bed is greater than 1.

2. A method according to claim 1, wherein the oxygen coefficient is adjusted to be at least 1.03.

3. A method according to claim 1, wherein the oxygen coefficient is adjusted by changing the temperature by adjusting an amount of material to be roasted.

4. A method according to claim 1, wherein the oxygen coefficient is adjusted by changing the amount of roasting air.

5. A method according to claim 1, wherein the roasting gas is air.

6. A method according to claim 1, wherein the oxygen-enriched air is used as the roasting gas.

7. A method according to claim 6, wherein the oxygen coefficient is adjusted by changing the oxygen enrichment of the roasting gas.

8. A method according to claim 1, wherein the oxygen content measurement from the bed is made continuously.

9. A method according to claim 1, wherein the oxygen content measurement from the bed is carried out when changing the feed mixture.

10. A method according to claim 1, wherein the material to be roasted is a zinc concentrate.

11. A method according to claim 1, wherein the material to be roasted is an iron-containing sulfide concentrate.

* * * * *